US010329850B2

(12) United States Patent
Nicholson

(10) Patent No.: US 10,329,850 B2
(45) Date of Patent: Jun. 25, 2019

(54) RELEASABLE LOCKING MECHANISM

(71) Applicant: OneSubsea IP UK Limited, London (GB)

(72) Inventor: Joseph Allan Nicholson, Barrow-in-Furness (GB)

(73) Assignee: ONESUBSEA IP UK LIMITED, London, England (GB)

( * ) Notice: Subject to any disclaimer, the term of this patent is extended or adjusted under 35 U.S.C. 154(b) by 139 days.

(21) Appl. No.: 15/668,979

(22) Filed: Aug. 4, 2017

(65) Prior Publication Data

US 2018/0038169 A1 Feb. 8, 2018

(30) Foreign Application Priority Data

Aug. 8, 2016 (GB) ..... 1613572.5

(51) Int. Cl.

| | |
|---|---|
| ***E21B 17/02*** | (2006.01) |
| ***E21B 17/06*** | (2006.01) |
| ***E21B 19/16*** | (2006.01) |
| ***E21B 31/18*** | (2006.01) |

(52) U.S. Cl.

CPC ..... *E21B 17/023* (2013.01); *E21B 17/06* (2013.01); *E21B 19/165* (2013.01); *E21B 31/18* (2013.01)

(58) Field of Classification Search

CPC ..... E21B 17/023; E21B 17/06; E21B 17/046; E21B 31/18; E21B 31/20

See application file for complete search history.

(56) References Cited

U.S. PATENT DOCUMENTS 1,409,066 A * 3/1922 Russ ..... E21B 17/023 403/11
4,061,389 A * 12/1977 Keller ..... E21B 23/006 175/315
4,066,282 A * 1/1978 Vann ..... E21B 17/046 285/315
4,185,865 A * 1/1980 Taylor ..... E21B 23/006 294/86.18

(Continued)

FOREIGN PATENT DOCUMENTS

CA 2452858 A1 * 6/2005 ..... E21B 17/06
GB 2551211 A * 12/2017 ..... E21B 17/023

(Continued)

OTHER PUBLICATIONS

Search and Examination Report issued in Great Britain Patent Appl. No. GB1613572.5 dated Oct. 17, 2017; 5 pages.

*Primary Examiner* — Jennifer H Gay
(74) *Attorney, Agent, or Firm* — Fletcher Yoder, P.C.

(57) ABSTRACT

A releasable locking mechanism 20 for use in a downhole well 10 is provided. The releasable locking mechanism 20 is suitable for use in a cable termination assembly 11. The cable termination assembly 11 is coupled to a downhole apparatus 12 and is configured for coupling a cable line 13 thereto. The releasable locking mechanism 20 includes an extension tube 21 adapted to be coupled to the cable line 13, and a base assembly 23 adapted to be coupled to the cable termination assembly 11. The extension tube 21 and the base assembly 23 are adapted to releasably engage each other in such a manner that when a tensile load in the cable line 13 exceeds a predefined threshold value, the extension tube 21 and the base assembly 23 are disengaged.

12 Claims, 16 Drawing Sheets

(56) References Cited

U.S. PATENT DOCUMENTS 4,648,444 A * 3/1987 Busch ..... E21B 17/023 166/65.1
5,024,277 A * 6/1991 Ricles ..... E21B 23/00 166/381
5,109,921 A * 5/1992 Aracena ..... E21B 17/023 166/377
5,197,773 A * 3/1993 Vick, Jr. ..... E21B 23/00 294/86.18
5,363,921 A * 11/1994 Mendez ..... E21B 23/00 166/123
5,683,115 A 11/1997 Hill
6,032,733 A * 3/2000 Ludwig ..... E21B 17/023 166/385
6,269,883 B1 * 8/2001 Gissler ..... E21B 17/023 166/241.5
7,373,974 B2 * 5/2008 Connell ..... E21B 17/06 166/242.1
7,426,964 B2 * 9/2008 Lynde ..... E21B 17/06 166/123
9,771,762 B2 * 9/2017 Baudoin ..... E21B 17/06
9,834,997 B2 * 12/2017 Nicholson ..... E21B 17/06
9,945,189 B2 * 4/2018 Richards ..... E21B 17/06
10,036,212 B2 * 7/2018 Gourmelon ..... E21B 17/023
10,132,131 B2 * 11/2018 Vick, Jr. ..... E21B 23/00
2005/0126775 A1 * 6/2005 Van Nguy ..... E21B 17/06 166/125
2006/0113083 A1 * 6/2006 Connell ..... E21B 17/06 166/377
2006/0131011 A1 * 6/2006 Lynde ..... E21B 17/06 166/123
2013/0312996 A1 * 11/2013 Nicholson ..... H02G 9/065 174/50.52
2015/0226018 A1 * 8/2015 Baudoin ..... E21B 17/06 166/377
2016/0153248 A1 * 6/2016 Richards ..... E21B 17/07 166/335
2016/0245024 A1 * 8/2016 Nicholson ..... E21B 17/06
2017/0030159 A1 * 2/2017 Vick, Jr. ..... E21B 23/00
2017/0167204 A1 * 6/2017 Drenth ..... E21B 17/042
2017/0362902 A1 * 12/2017 Gourmelon ..... H01R 13/5202
2018/0038169 A1 * 2/2018 Nicholson ..... E21B 17/06
2018/0045005 A1 * 2/2018 Holmberg ..... E21B 17/06
2018/0058154 A1 * 3/2018 Kitchen ..... E21B 17/06

FOREIGN PATENT DOCUMENTS

WO 2014065814 A1 5/2014
WO 2014193419 A1 12/2014
WO 2016028162 A1 2/2016
WO WO-2016134151 A1 * 8/2016 ..... E21B 17/06
WO WO-2016140678 A1 * 9/2016 ..... E21B 23/00

* cited by examiner

RELEASABLE LOCKING MECHANISM

CROSS REFERENCE TO RELATED APPLICATIONS

This application claims priority to GB Patent Application No. 1613572.5, filed Aug. 8, 2016, which is incorporated by reference herein in its entirety.

TECHNICAL FIELD

The present disclosure generally relates to a releasable locking mechanism and in particular, to a releasable locking mechanism for use in a cable termination assembly, the cable termination assembly being fixedly coupled to a downhole apparatus and configured for coupling a cable line thereto, and a method for using the same.

BACKGROUND

Various techniques for implementing artificial lift to increase the flow of liquids from a downhole well are known. Such techniques typically involve inland or offshore wells in which a sub-surface downhole apparatus is deployed in the well using wireline, coiled tubing or umbilical cable arrangements, which connect the downhole apparatus to a well-head. As part of routine maintenance or in order to address fault conditions, the downhole apparatus may need to be retrieved from the well.

One of the challenges faced during retrieval is that there is a risk that the downhole apparatus will become stuck in the well, a situation that may arise due to scaling or debris accumulation and other similar factors. The downhole apparatus is typically deployed in a bore with small levels of clearance and hence, relatively small level of scaling or debris accumulation has the potential to affect retrieval.

When the tensile load that may be applied through the cable line is insufficient to successfully retrieve the downhole apparatus, the downhole apparatus must still be removed from the downhole well using other means. Various fishing tools are available to retrieve the downhole apparatus. However, before a fishing operation is performed, it is imperative that the cable line attached to the downhole apparatus is removed so that the downhole bore is clear to rig up the fishing equipment.

In order to address this situation, it is known to incorporate a weak link design in the coupling between the cable line and the downhole apparatus so that when a tensile load substantially greater than the normal operating load is applied, the cable line may be disengaged from the downhole apparatus.

In the past solutions, such as those known from U.S. Pat. Nos. 5,683,115 and 5,109,921, based on mechanical weak link designs using shear pins were proposed. One of the problems with this solution is that the broken pieces of shear pins or bolts, created during the operation of the weak link, further aggravate the problem of debris accumulation over the downhole apparatus. Moreover, such solutions lacked sufficient precision and reliability of operation. Accordingly, other solutions based on electrical and hydraulic actuation systems have been proposed in recent years. While the recent solutions increase the precision, one disadvantage is that in a fault scenario, if the hydraulic or the electrical actuation of the downhole release mechanism becomes inoperable, successfully fishing out the downhole apparatus becomes extremely difficult and cost prohibitive, if not impossible.

Reliable operation of the weak link is of paramount importance. In the event that the weak link fails to operate in the intended manner and the cable line breaks in the region near the well-head, the problem is exacerbated because the cable line, which is typically thousands of feet in length, slides into and clogs the bore of the downhole well and itself needs to be fished out before a fishing operation to retrieve the downhole apparatus may be performed. The breakage of the cable line near an offshore platform results in the additional problem of a pile of the cable line over the well-head on the sea bed.

In light of the foregoing, there is a need for a reliable releasable locking mechanism to releasably couple a cable line to a downhole apparatus.

SUMMARY

Accordingly, the present disclosure provides a releasable locking mechanism and a method of using the same.

The present disclosure provides a releasable locking mechanism according to claim 1 and a method according to claim 12. Further embodiments of the present disclosure are addressed in the dependent claims.

The present disclosure enables to provide a release collet that latches an extension tube attached to a cable line. In an embodiment, the release collet is biased in a latched state through the combined action of an end cap and a release ring. In an embodiment, the end cap is biased toward a base fixedly secured to a cable termination assembly, which in turn is fixedly coupled to the downhole apparatus. The biasing of the end cap toward the base might be achieved using an extendible retaining means. When the tensile load applied to the cable line exceeds a predefined threshold value, the extendible retaining means permit the end cap to transition from a locking position to a release position. As the end cap transitions from the locking position to the release position, the release collet displaces axially away from the base and expands radially outwards into a recess formed on the inner surface of the release ring. As a result, the extension tube is released.

In an embodiment of the present disclosure, a releasable locking mechanism for use with a cable termination assembly is provided. The cable termination assembly might be coupled to a downhole apparatus and configured for coupling a cable line thereto. The releasable locking mechanism comprises an extension tube and a base assembly. The extension tube is adapted to be coupled to the cable line and provided with a first mating profile, and the base assembly is adapted to be coupled to the cable termination assembly and further adapted to engage the extension tube.

In an embodiment, the base assembly comprises a base adapted to be coupled to the cable termination assembly, a release ring mounted on the base and provided with a recess, an end cap, an extendible retaining means arranged to bias the end cap toward the base and adapted to permit an axial displacement of the end cap from a locking position to a release position relative to the base when a tensile load in the cable line exceeds a predefined threshold value, and a release collet provided with a second mating profile adapted for mating with the first mating profile.

In the embodiment, when the end cap is held in the locking position, the release collet is restrained from displacement in an axial direction away from the base by the end cap and in a radial direction by the release ring such that the first and second mating profiles are engaged, thereby retaining the extension tube, and when the end cap is displaced to the release position, the release collet is permitted to displace in an axial direction away from the base and expand in the radial direction at least partially into the recess of the release ring such that the first and second mating profiles are disengaged, thereby releasing the extension tube.

Thus, the present disclosure provides a releasable locking mechanism that relies on mechanical actuation and obviates the need for provision of cumbersome and error-prone hydraulic or electrical actuation systems. The extendible retaining means can be configured with precision to achieve a release at a predefined threshold value of the tensile load applied to the cable line. As the releasable locking mechanism according to an embodiment of the disclosure does not depend on availability and operability of electrical and/or hydraulic supply lines downhole but instead, relies on application of tensile load to the cable line, the releasable locking mechanism is not only much more precise but also highly reliable. While the releasable locking mechanism disclosure is based on a mechanical design, the mechanism advantageously does not rely on shearing or breaking coupling elements such as shear pins in order to release the cable line from the downhole apparatus. Accordingly, the problems associated with broken pieces of coupling means such as shear pins are advantageously avoided.

In an embodiment of the disclosure, the first mating profile may comprise a first set of circumferential recessed profiles spaced apart in an axial direction and provided on an outer surface of the extension tube, and the second mating profile comprises a second set of circumferential recessed profiles spaced apart in an axial direction and provided on an inner surface of the release collet. This technical feature does not require specific rotational alignment for achieving precise engagement between the release collet and the extension tube.

In an embodiment of the disclosure, the recess in the release ring may be part of a first toothed profile in an axial direction on the inner surface of the release ring, and the release collet may be provided with a second toothed profile adapted for mating with the first toothed profile, and where the release ring and the release collet are arranged such that when the end cap is held in the locking position, the first and second toothed profiles engage in a non-mating manner, whereby the release collet might be biased toward the extension tube, and when the end cap is displaced to the release position and the release collet displaces in the axial direction away from the base, the first and second toothed profiles engage in a mating manner, and thereby, permit radial expansion of the release collet. This feature enables the individual toothed profiles on the release ring and the release collet to be shaped in such a manner that the tensile load in the cable line for releasing the extension tube can be varied during the displacement of the end cap and the release collet away from the base from a relatively high value in the beginning to progressively lower values subsequently. As a result, the time duration for which the cable line is subjected to high tensile load is relatively reduced.

In an embodiment of the disclosure, the base assembly may comprise a sealing member disposed at an interface between the extension tube and the base. According to this technical feature, the interface between the extension tube and the base assembly may be sealed so as to prevent ingress of ambient gas and/or liquid into a spatial region delimited by the extension tube and the base assembly, which is in continuum with the inner cavity within the cable termination assembly.

In an embodiment of the disclosure, the base assembly comprises a seal compression ring disposed between the sealing member and the release collet such that when the end cap is in the locked position, the seal compression ring compresses the sealing member such that the sealing member is urged toward respective inner surfaces of the base and the extension tube. In this manner, the efficacy of the sealing member might be improved.

In an embodiment of the disclosure, the extension tube may be provided with a set of anti-rotation slots, and the end cap may be provided with a set of anti-rotation latches, wherein each anti-rotation latch comprises a sprung key and a casing, and protrudes radially inwards from a corresponding housing slot formed in an inner surface of the end cap, wherein the casing is profiled to prevent a rotational motion of the extension tube about the axial direction but permit a translational motion of the extension tube in the axial direction. Rotation of the extension tube relative to the base assembly can thus be prevented, and thereby undesirable torsional forces on the supply cables coupled to the downhole apparatus through the cable termination assembly might be avoided.

In an embodiment of the disclosure, the extendible retaining means may comprise at least one tension bolt, each tension bolt comprising at least a head region, a tail region, and a weak neck region, wherein the tension bolts extend in the axial direction, wherein the head region is engaged by the end cap, the tail region is engaged by the base, and the weak neck region extends through the release ring. The tension bolts exhibit precise stress-strain interrelationship and thus, enable precise and reliable characterisation of releasable locking mechanism in respect of required tensile load to release the extension tube.

In an embodiment of the disclosure, the extendible retaining means may comprise a set of tension bolts, each tension bolt comprising at least a head region, a tail region, and a weak neck region, wherein the tension bolts are uniformly distributed along a periphery of the end cap, and extend along the axial direction, wherein the head region is engaged by the end cap, the tail region is engaged by the base, and the weak neck region extends through the release ring. The uniform distribution of the tension bolts, as per this technical feature, evenly distributes the tensile load over multiple tension bolts along the periphery of the end cap.

The release collet may be a multi-piece collet comprising a plurality of longitudinally extending sub-parts coupled in a pair-wise manner in a circumferential direction. Beneficially, the individual pieces of the release collet are better suited to expand radially outwards into the recess of the release ring as compared to a release collet with a monolithic design.

When the extension tube and the base assembly are engaged, a load path traverses through the extension tube, the first mating profile on the extension tube, the second mating profile on the release collet, the release collet, the end cap, the extendible retaining means and the base. Accordingly, when a tensile load is applied to the cable line coupled to the extension tube, the tensile load is transmitted through the load path and the extendible retaining means, among others, is also subjected to the applied tensile load. Additionally, due to the load path, when the downhole apparatus becomes stuck in the well and a tensile load greater than a predefined threshold value is applied to the cable line, the extension tube transmits the tensile load to the release collet, which in turn, forces the end cap in an axial direction away from the base and in this process, the release collet also displaces away from the base.

In an embodiment of the disclosure, the base assembly may comprise a fishing profile secured to the base through a retaining ring so as to permit a fishing operation to be carried out to retrieve the downhole apparatus subsequent to release of the extension tube and removal of the cable line from the downhole well.

In a second aspect of the present disclosure, a method is provided. A cable line might be coupled to a downhole apparatus through a releasable locking mechanism as provided with the present disclosure. A tensile load might be applied to the cable line equal to or greater than the predefined threshold value such that the cable line is disengaged from the downhole apparatus.

BRIEF DESCRIPTION OF DRAWINGS

The present disclosure will now be further described with reference to illustrated embodiments shown in the accompanying drawings, in which.

DETAILED DESCRIPTION

Figure 1:
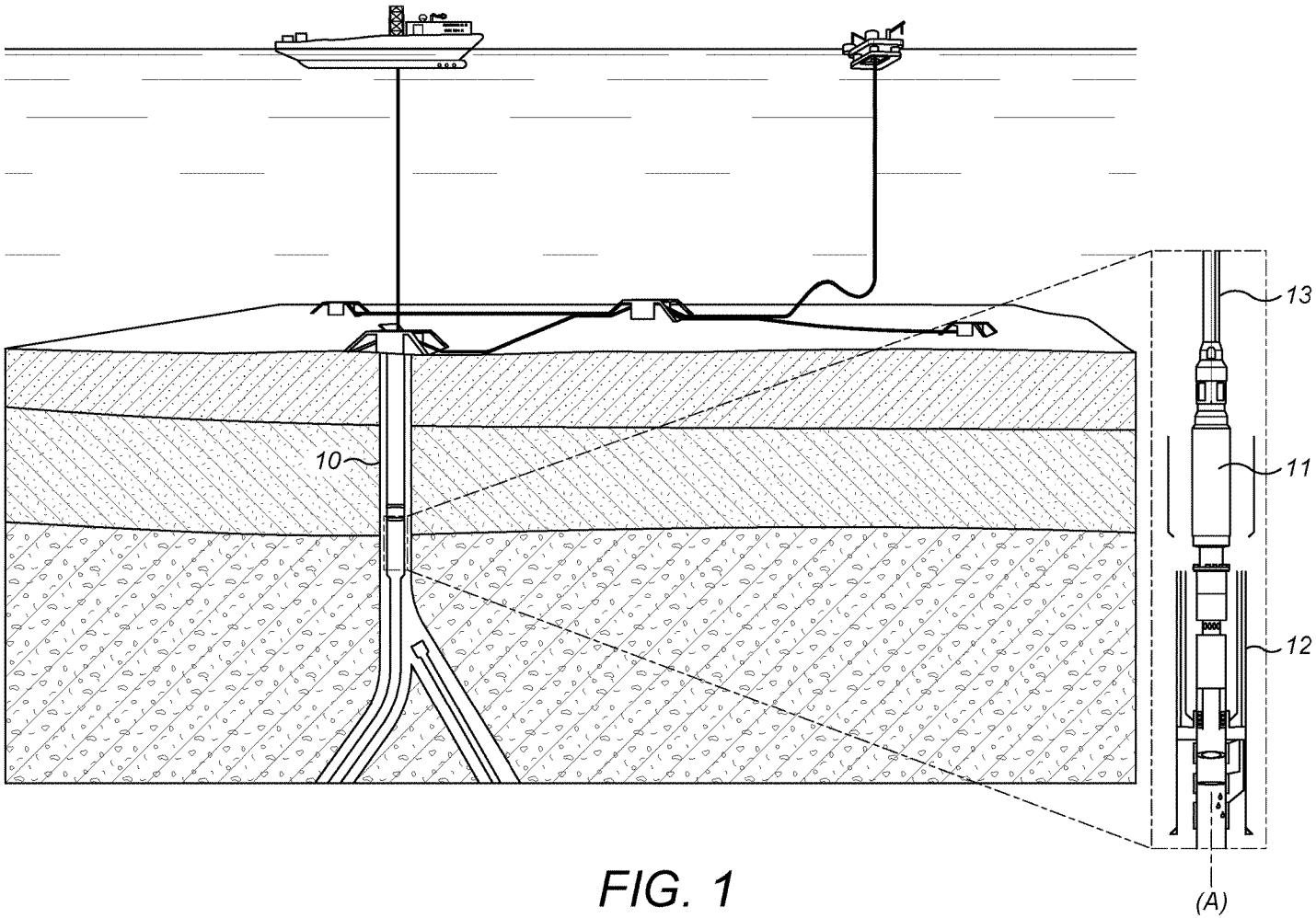
FIG. 1 depicts a schematic representation of a downhole well in which various embodiments may be practiced.

Various embodiments are described with reference to the drawings, wherein like reference numerals are used to refer to like elements throughout. In the following description, for purpose of explanation, numerous specific details are set forth in order to provide a thorough understanding of one or more embodiments. It may be evident that such embodiments may be practiced without these specific details.

FIG. 1 depicts a schematic representation of a downhole well 10 in which various embodiments of the present disclosure may be practiced. As shown in the figure, a downhole apparatus 12 is deployed in the downhole well 10. The downhole apparatus 12 is suspended from the cable line 13 using the cable termination assembly 11, which is adapted to couple the downhole apparatus 12 to the cable line 13.

The cable line 13 may be a wireline cable, coiled tubing, or an umbilical cable. In an example, the downhole apparatus 12 is suspended using a wireline cable that terminates in a rope socket. Various supply cables, such as electrical, instrumentation and hydraulic are run along the wireline cable and are attached thereto for mechanical support. In contrast, when using a coiled tubing or an umbilical cable, the supply cables may reside within a tubing cable that is coupled to the downhole apparatus 12 using the cable termination assembly 11.

The concepts described herein are applicable to any possible variations in the manner in which the downhole apparatus 12 is suspended in the downhole well 10. In particular, the term "cable line" as used herein is intended to encompass, within its meaning, wireline, coiled tubing, umbilical cable and any other analogous or equivalent implementations.

The releasable locking mechanism of the present disclosure is suitable for use in any coupling assembly intermediate to the downhole apparatus 12 and the cable line 13 such that when the need arises, the releasable locking mechanism may be actuated to decouple the cable line 13 from the downhole apparatus 12.

Figure 2:
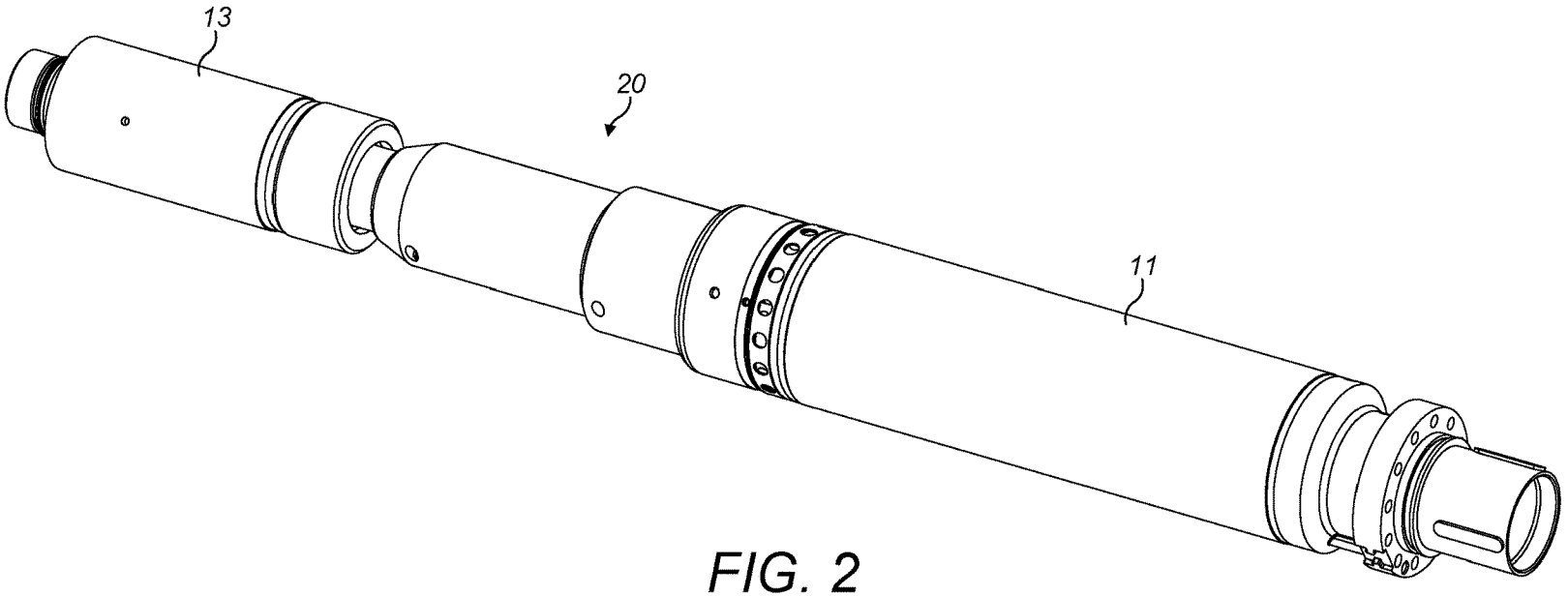
FIG. 2 depicts a releasable locking mechanism in an engaged state in accordance with some embodiments.
Figure 3:
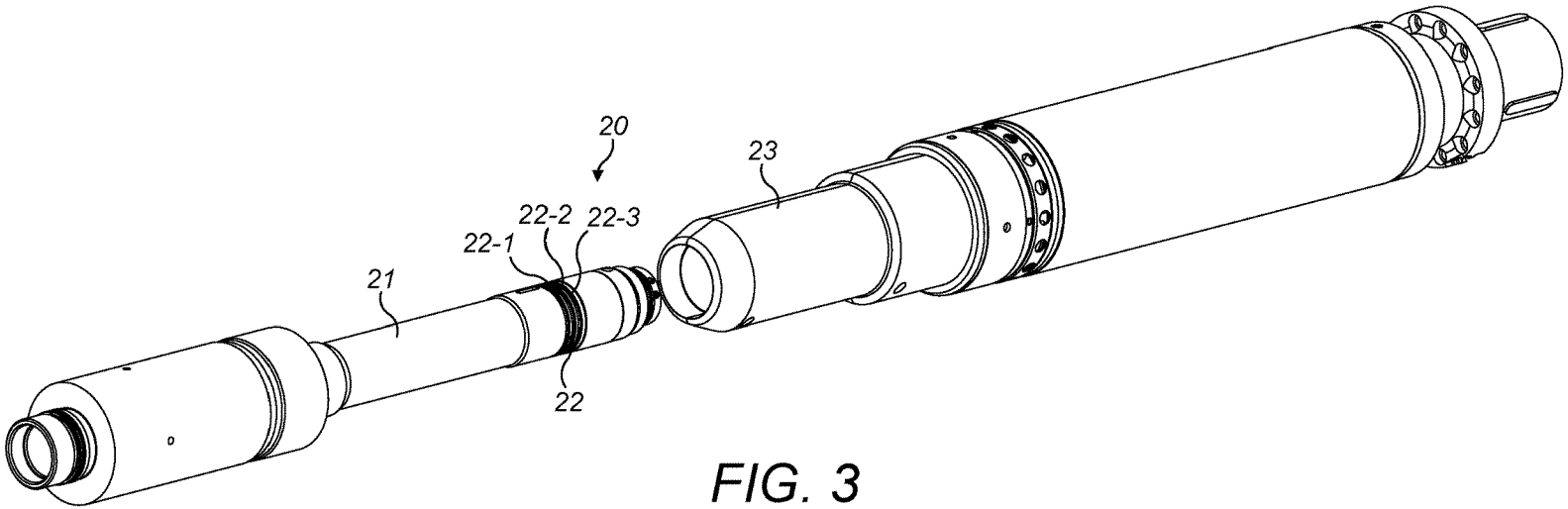
FIG. 3 depicts a releasable locking mechanism in a disengaged state in accordance with some embodiments.

Referring now to FIGS. 2 and 3, an embodiment of a releasable locking mechanism 20 of the disclosure is depicted in two distinct states. In particular, FIG. 2 depicts the releasable locking mechanism 20 in an engaged state while FIG. 3 depicts the releasable locking mechanism 20 in a disengaged state.

As shown in the examples of FIGS. 2 and 3, the releasable locking mechanism 20 includes an extension tube 21 and a base assembly 23. The extension tube 21 is adapted to be coupled to the cable line 13. The extension tube 21 may be coupled to cable line 13 in any suitable manner. In one embodiment, the extension tube 21 is a hollow elongated tubular member such that the supply cables such as electrical wires, instrumentation cables, and hydraulic cables are permitted to pass there through and enter into the cable termination assembly 11 coupled to the downhole apparatus 12. The extension tube 21 is provided with a first mating profile 22. The base assembly 23 is adapted to be coupled to the cable termination assembly 11 and is further adapted to engage the extension tube 21. In particular, the base assembly 23 is provided with a release collet that has a second mating profile suitable for mating with the first mating profile 22 so as to removably engage the extension tube 21. The release collet and the corresponding features will be described in more detail below.

Various individual components constituting the base assembly 23 will now be described in more detail in conjunction with FIGS. 4A, 4B, 5 and 6.

Figure 4A:
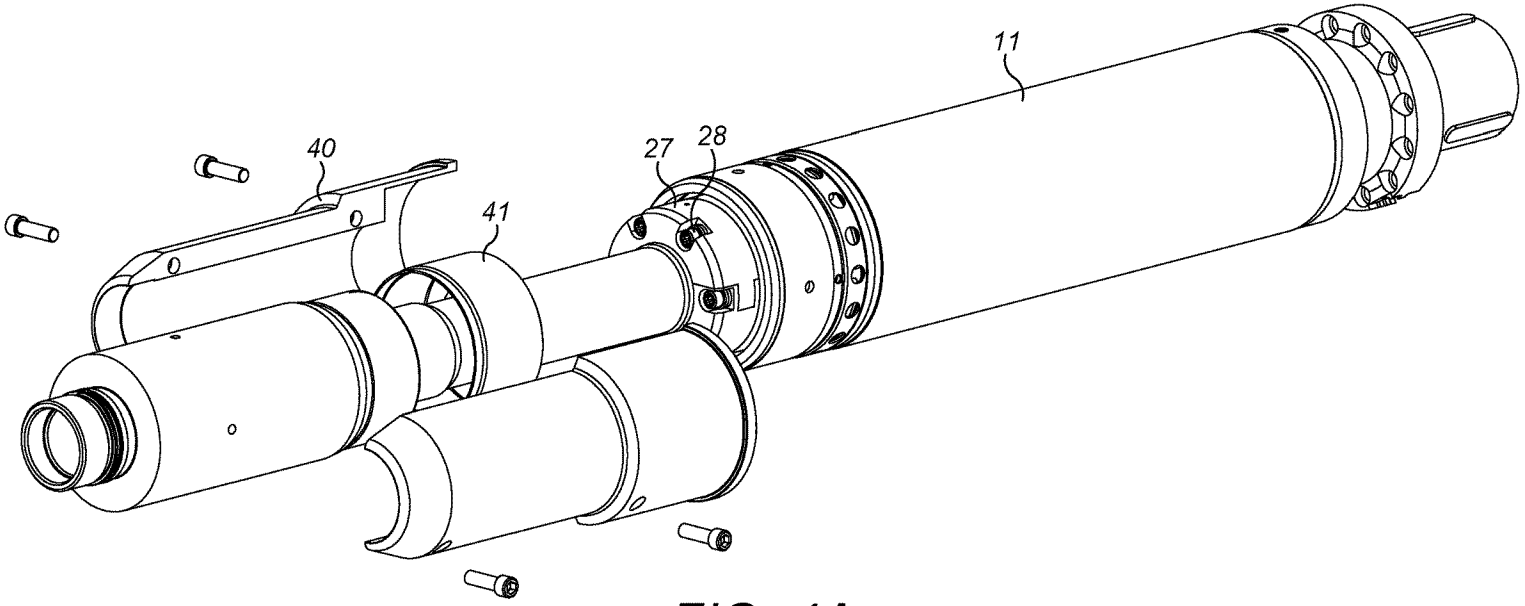
FIGS. 4A-4B depict two partially exploded views of a releasable locking mechanism in accordance with some embodiments.
Figure 4B:
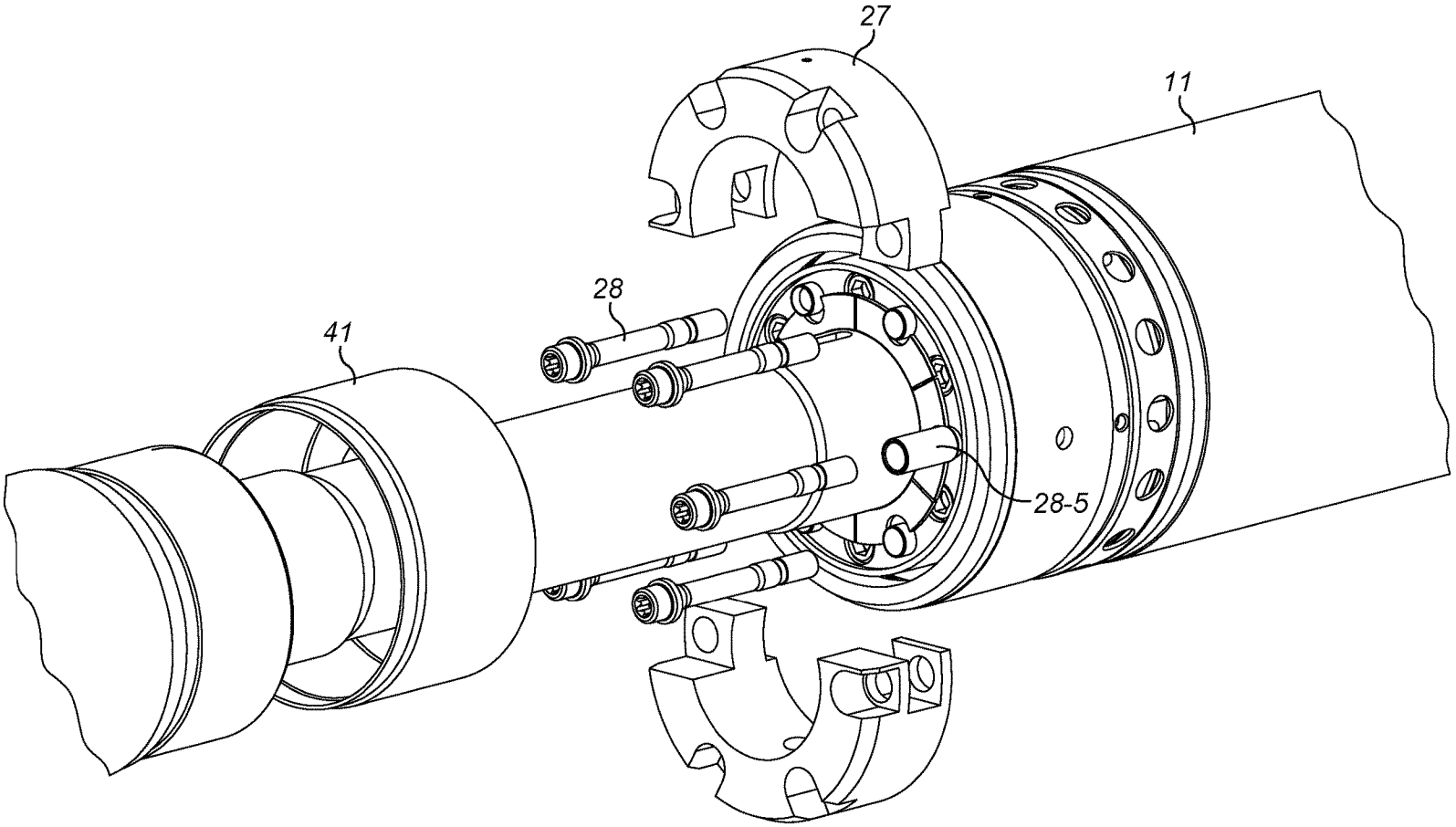
Figure 5:
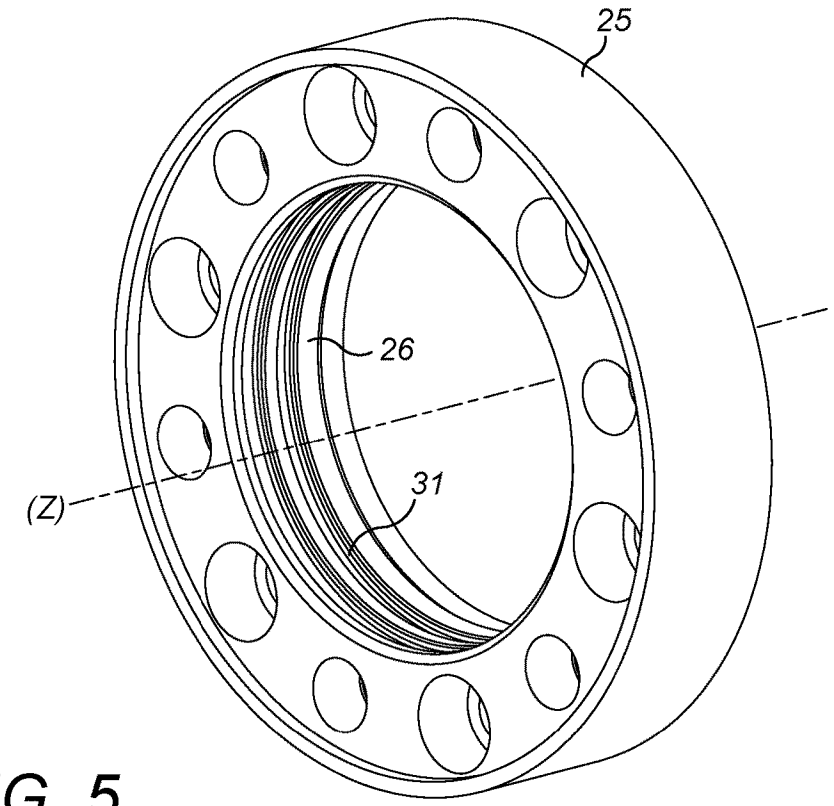
FIG. 5 depicts a perspective view of a release collet and a release ring in accordance with some embodiments.
Figure 5:
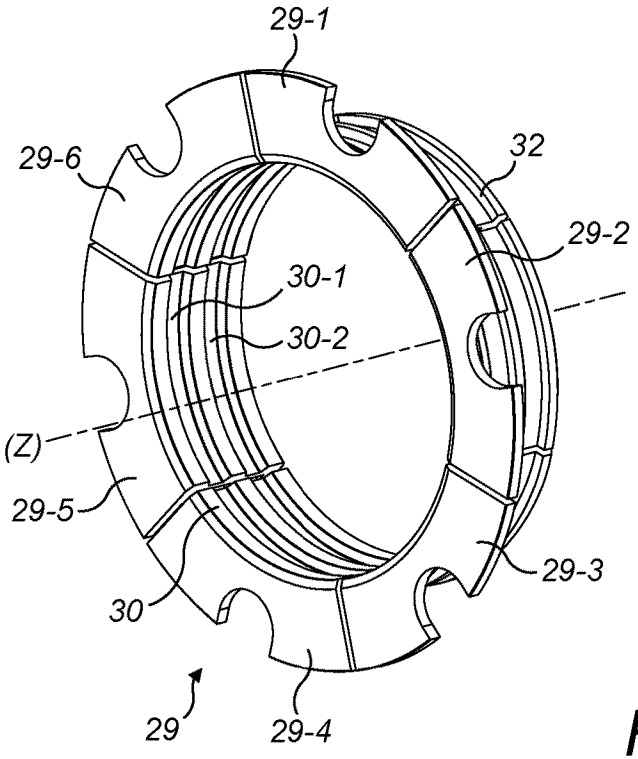
Figure 6:
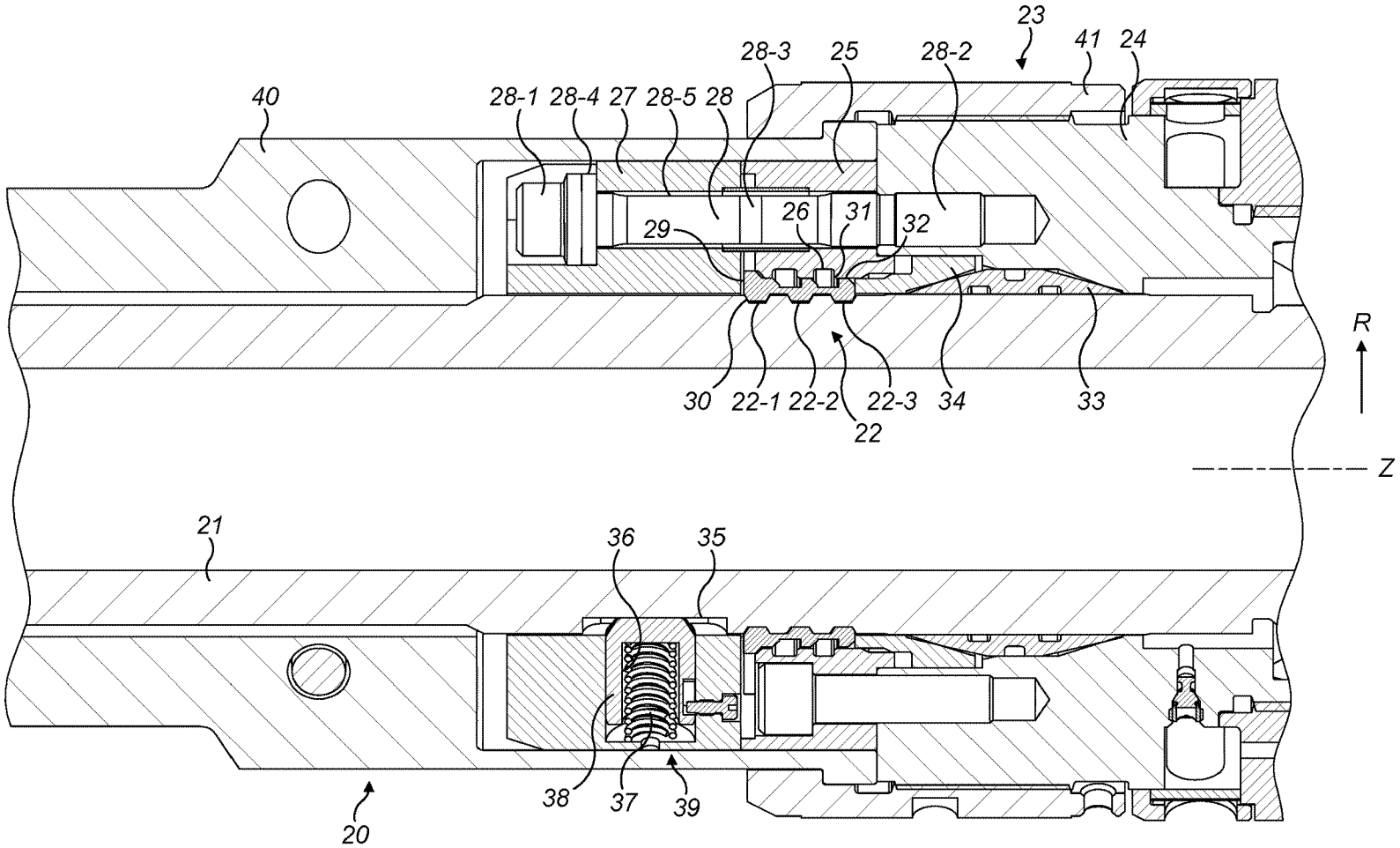
FIG. 6 depicts a cross-sectional view of a releasable locking mechanism in accordance with some embodiments.

FIGS. 4A and 4B depict two partially exploded views of a releasable locking mechanism and FIG. 5 depicts a perspective view of a release collet 29 and a release ring 25 in accordance with embodiments of the disclosure. FIG. 6 depicts a cross-sectional view of a releasable locking mechanism 20.

The base assembly 23 includes a base 24, a release ring 25, an end cap 27, an extendible retaining means 28 and a release collet 29. The base 24 is adapted to be coupled to the cable termination assembly 11. The base 24 may be coupled to the cable termination assembly 11 in any suitable manner. In one example, a threaded engagement is used. The base 24 is provided with threads on the outer surface in the end region to be engaged with the cable termination assembly 11. The cable termination assembly 11 is provided with matching threads on the inner surface in the end region thereof. Thus, the base 24 is engaged to the cable termination assembly 11 in a threaded manner. Various alternative threaded engagements based on sleeves and/or collar type engagements may alternatively be used. In another implementation, the base 24 may be provided with a radially outwards extending terminal flange which is attached to the cable termination assembly 11 using bolts. In various embodiments, the base 24 has a through hole such as to permit passage of supply cables there through.

The release ring 25 is mounted on the base 24 using any suitable mounting means. It should be noted that in an embodiment, instead of being formed as individual components, the base 24 and the release ring 25 is formed as an integral component.

The release ring 25 is provided with a recess 26. The recess 26 is formed on an inner surface of the release ring 25 and is adapted according to the structure of the release collet 29. The release ring 25 resides in between the base 24 and the end cap 27 and thus, the end cap 27 is held in a spaced relationship relative to the base 24. The extendible retaining means 28 is arranged to bias the end cap 27 toward the base 24. The extendible retaining means 28 is adapted to permit an axial displacement of the end cap 27 from a locking position (L) to a release position (R) relative to the base 24 when a tensile load in the cable line 13 exceeds a predefined threshold value. The release collet 29 is provided with a second mating profile 30 that is adapted for mating with the first mating profile 22.

As best seen in FIG. 5, in an embodiment, the release collet 29 is a multi-piece collet formed using a plurality of longitudinally extending sub-parts 29-1 to 29-6 coupled in a pair-wise manner in a circumferential direction.

In the embodiment depicted in FIG. 5, six individual pieces are coupled to form the release collet 29. It should be noted that the release collet 29 may have fewer or more pieces. For example, the release collet 29 may be formed using only the pieces 29-1, 29-3 and 29-5. Thus, in this implementation, the release collet 29 spans over the circumference of the extension tube 21 in a discontinuous manner. The first mating profile 22 and the first toothed profile 31 may be adapted accordingly. Alternatively, the first mating profile 22 and the first toothed profile 31 may remain unchanged to maintain rotational symmetry.

Further, in the embodiment depicted in FIGS. 4A and 4B, the end cap 27 has a split design, which is to say, it is in a two part form, as best seen in FIG. 4B. Such a design of the end cap 27 facilitates on-site assembly of the releasable locking mechanism 20 and advantageously results in an overall more compact design of the releasable locking mechanism 20 and in particular, that of the extension tube 21.

Referring particularly to FIG. 6, a cross-sectional view of a releasable locking mechanism 20 is depicted.

As described above, the base 24 is coupled to the cable termination assembly 11. The release ring 25 is mounted on the base 24. The end cap 27 is coupled to the base 24 using the extendible retaining means 28.

The extension tube 21 is engaged or disengaged based on relative state of mating between the first mating profile 22 provided on an outer surface of the extension tube 21 and the second mating profile 30 provided on an inner surface of the release collet 29. In FIG. 6, the first mating profile 22 and the second mating profile 30 are shown in a mated state.

In an embodiment, the first mating profile 22 is formed using a first set of circumferential recessed profiles 22-1, 22-2, 22-3 spaced apart in the axial direction (Z) and provided on an outer surface of the extension tube 21 and the second mating profile 30 is formed using a second set of circumferential recessed profiles 30-1, 30-2 spaced apart in the axial direction (Z) and provided on an inner surface of the release collet 29.

The release ring 25 is provided with a first toothed profile 31 in the axial direction (Z) on the inner surface of the release ring 25 such that the recess 26 is a part thereof. In other words, multiple recesses 26 might be provided on the release ring 25 by way of the first toothed profile 31. The release collet 29 is provided with a second toothed profile 32 adapted for mating with the first toothed profile 31.

The release ring 25 and the release collet 29 are arranged within the releasable locking mechanism 20 in such manner that when the end cap 27 is held in the locking position (L), the first and second toothed profiles 31, 32 engage in a non-mating manner, whereby the release collet 29 is biased toward the extension tube 21. The assembly is shown in this state in FIG. 6.

As will be explained in more detail below in conjunction with FIGS. 7A-7B and 8A-8B, when the end cap 27 is displaced to the release position (R) and the release collet 29 displaces in the axial direction (Z) away from the base 24, the first and second toothed profiles 31, 32 engage in a mating manner, and thereby, permit radial expansion of the release collet 29, whereby the extension tube 21 is disengaged from the base assembly 23.

The base assembly 23 may also include a sealing member 33 disposed at an interface between the extension tube 21 and the base 24. In an example, as depicted in FIG. 6, a metal ring seal with a circular segment shaped cross-section, arranged such the flat face interfaces with the extension tube 21, is used as the sealing member 33. The base 24 and the extension tube 21 are cylindrical tubular members with the outer diameter of the extension tube 21 being marginally less than the inner diameter of the base 24 such that the extension tube 21 may be snugly inserted into the base 24. The inner surface at a terminal region of the base 24 diverges outwards to increase the cross-sectional area of the cavity bounded by the base 24 so as to permit the sealing member 33 to be disposed between the base 24 and the extension tube 21, as shown in FIG. 6.

The base assembly 23 may also include a seal compression ring 34 disposed between the sealing member 33 and the release collet 29 such that when the end cap 27 is in the locking position (L), the seal compression ring 34 compresses the sealing member 33 such that the sealing member 33 is urged toward respective inner surfaces of the base 24 and the extension tube 21.

The provision of sealing member 33 and the seal compression ring 34 facilitate sealing the interface between the extension tube 21 and the base assembly 23 such as to prevent ingress of ambient gas and/or liquid into a spatial region bound by the extension tube 21 and the base assembly 23, which is in continuum with the inner cavity within the cable termination assembly 11.

In an embodiment, the extension tube 21 is provided with a set of anti-rotation slots 35, and the end cap 27 is provided with a set of anti-rotation latches 36, wherein each anti-rotation latch 36 includes a sprung key 37 and a casing 38, and protrudes radially inwards from a corresponding housing slot 39 formed in an inner surface of the end cap 27, wherein the casing 38 is shaped to prevent a rotational motion of the extension tube 21 about the axial direction (Z) but permit a translational motion of the extension tube 21 in the axial direction (Z). In one example, the casing 38 has a wedge-shaped profile, wherein the upright faces are parallel to the axial direction (Z) while the slanting faces extend parallel to an axis orthogonal to the axial direction (Z). This technical feature may prevent rotational motion of the extension tube 21 relative to the base assembly 23 after being engaged thereto but permits the extension tube 21 to displace axially away from the base 24 while the releasable locking mechanism 20 transitions from the engaged state to the disengaged state.

In one embodiment, the extendible retaining means 28 includes a set of tension bolts, each tension bolt comprising at least a head region 28-1, a tail region 28-2, and a weak neck region 28-3. In this example, multiple tension bolts 28 might be used and these tension bolts 28 might be uniformly distributed along a periphery of the end cap 27, and extend in the axial direction (Z). The head region 28-1 is engaged by the end cap 27, the tail region 28-2 is engaged by the base 24, and the weak neck region 28-3 extends through the release ring 25. In an example, where the end cap 27 is split in section, dowel tubes 28-5 are employed to form a continuous passage for the tension bolts 28 to prevent a direct interface between the length of the tension bolts 28 and the release ring 25. The dowels 28-5 are inserted in through holes formed along an axial length of the release ring 25 and define a passage for the tension bolts 28 through the release ring 25. The use of tension bolts 28 is advantageous in that the tension bolts 28 can be adapted with high degree of precision in relation to applied stress and resulting strain. Thus, the displacement of the end cap 27 from the locking position (L) to the release position (R) can be precisely configured as a function of the tensile load in the cable line 13.

In various embodiments, the tension bolts 28 may be engaged to the base 24 in any suitable manner. In one example, tension bolts 28 are provided with threads in the tail region 28-2 to engage the base 24, which is provided with corresponding threaded bore holes to receive and engage the tail region 28-2 of the tension bolts 28. As can be seen in FIG. 6, a bolt collar 28-4 positioned under the bolt heads is also provided to prevent bolt disengagement due to vibrations in the base assembly 23 during operation. The bolt collar 28-4 might thus enable to provide vibration resistance and prevent the tension bolts from unwinding from their threads and loosening their pre-loaded tension. In one example, the bolt collar 28-4 is a cam locking washer.

In one implementation, a single tension bolt is used. In other implementations, the extendible retaining means 28 may be implemented using other means such as tension bar, compression spring, and so on.

In various embodiments of the present disclosure, when the extension tube 21 and the base assembly 23 are engaged in the manner shown in FIG. 6, a load path traverses through the extension tube 21, the first mating profile 22 on the extension tube 21, the second mating profile 30 on the release collet 29, the release collet 29, the end cap 27, the extendible retaining means 28 and the base 24.

In one implementation, the normal operating load is estimated to be up to about 30 klbs, the dimensions, including overall length, length of weak neck region 28-3, and the material of the tension bolts 28 is selected such that a load of about 45+/−5 klbs results in a strain value of 0.1, which in turn results in displacement of the end cap 27 from the locking position (L) to the release position (R).

In an embodiment, the base assembly 23 includes a fishing profile 40 secured to the base 24 through a retaining ring 41. This technical feature may enable the downhole apparatus 12 to be retrieved using appropriate fishing tools subsequent to release and removal of the cable line 13 through operating the releasable locking mechanism 20.

Any suitable material may be used to form the components of the releasable locking mechanism 20. In one example, the tension bolts 28 may be formed using Inconel® 625, the release ring 25, the release collet 29, the anti-rotation latch 36 including the sprung key 37 and the casing 38, the seal compression ring 34, and the extension tube 21 are formed using Inconel® 718. Inconel® alloys are high resistant to oxidation and corrosion and accordingly, are well suited for downhole applications due to extreme ambient temperature and pressure conditions. The sealing member 33 is formed using Hastelloy® C276. Hastelloy® C276 is highly corrosion resistant like Inconel® alloys and at the same time, exhibits relatively less hardness as compared to Inconel® alloys and hence, is suitable material for providing a metal seal. The metal seal can additionally be coated with a soft coating material such as silver to aid sealing performance by providing a compliant layer with the mating housing material.

Figure 7A:
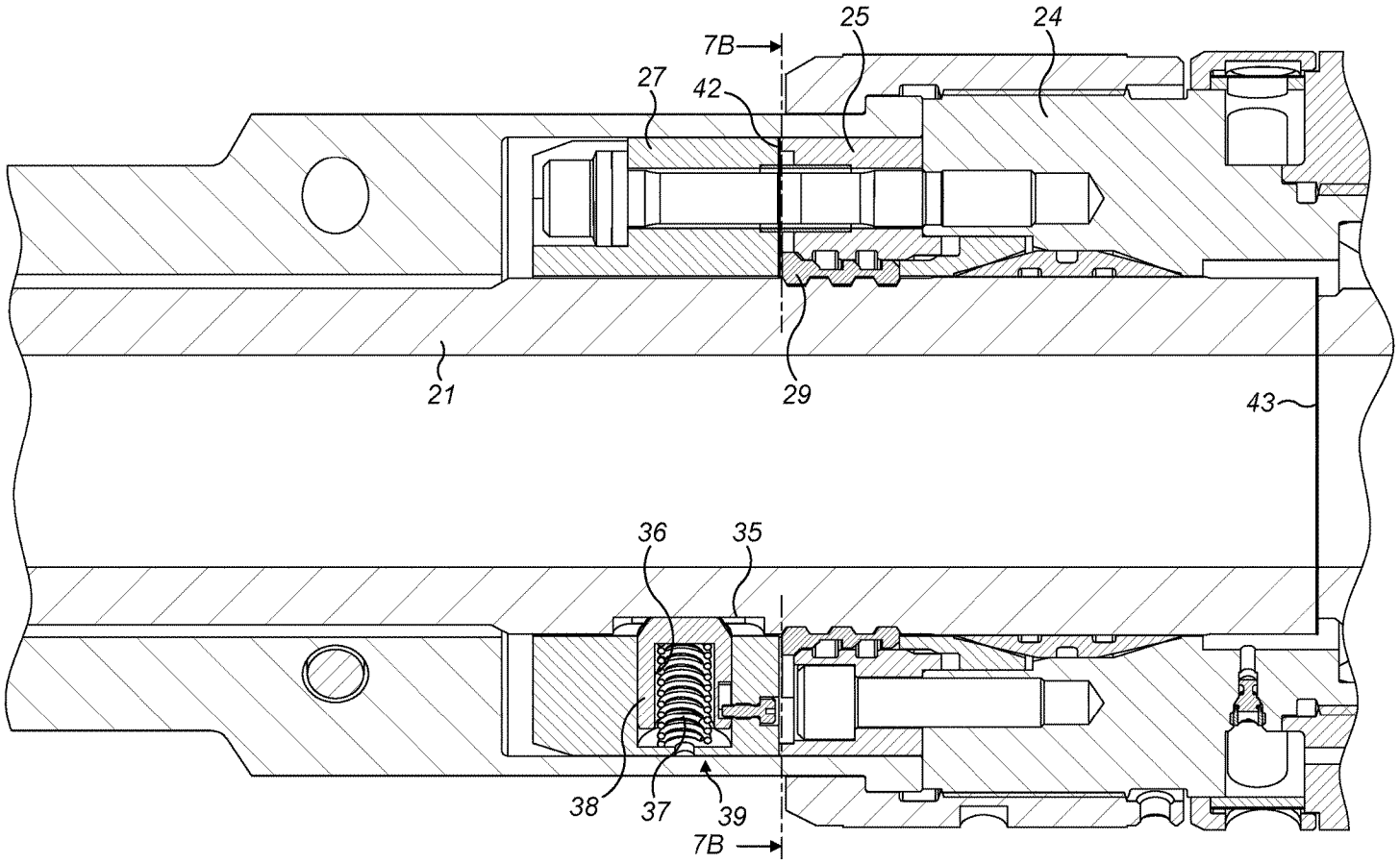
FIGS. 7A-7B depict cross-sectional views of a releasable locking mechanism in an engaged state in accordance with some embodiments.
Figure 7B:
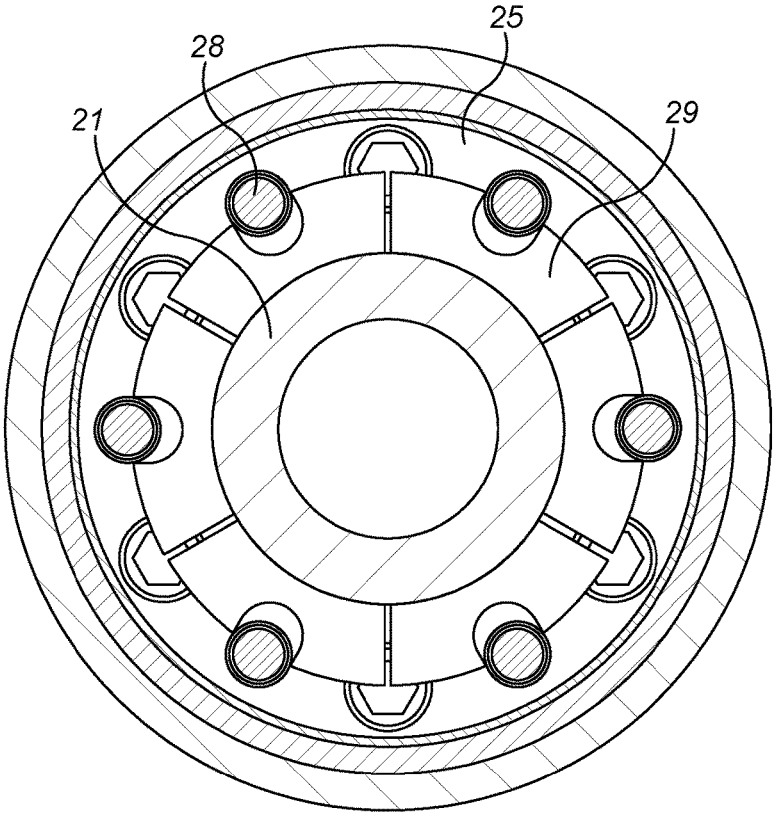

FIGS. 7A and 7B depict an axial cross-sectional view and a transverse cross-sectional view respectively of a releasable locking mechanism 20 in an engaged state.

The axial cross-sectional view provided in this figure is same as that in FIG. 6. Additional indications, indication 42 and indication 43, have been provided to indicate the locking position (L) of the end cap 27 and the corresponding position of the extension tube 21 respectively.

When the end cap 27 is held in the locking position (L), the release collet 29 is restrained from displacement in the axial direction (Z) away from the base 24 by the end cap 27. As mentioned above, the load path traverses through the extension tube 21, the first mating profile 22 on the extension tube 21, the second mating profile 30 on the release collet 29, the release collet 29, the end cap 27, the extendible retaining means 28 and the base 24. When the downhole apparatus 12 is suspended in the downhole well 10 using the cable line 13, under normal working conditions, the release collet 29 is prevented from axial movement relative to the release ring 25 in the axial direction (Z) away from the base 24 due to the combined action of the end cap 27 and the extendible retaining means 28. Additionally, the release collet 29 is restrained from expansion in the radial direction by the release ring 25 such that the first mating profile 22 and the second mating profile 30 are engaged, thereby retaining the extension tube 21.

As the tensile load in the cable line 13 and accordingly, across the load path through the releasable locking mechanism 20 increases beyond the normal operating load, the extendible retaining means 28 start extending, thereby permitting the end cap 27 to displace in the axial direction (Z) away from the base 24. Accordingly, the release collet 29 also starts to displace along with the end cap 27. As the tensile load continues to increase, the end cap 27 and the release collet 29 continue to displace away from the base 24. As described above, the release ring 25 is mounted on the base 24 and does not undergo axial movement relative to the base 24. When the tensile load reaches or exceeds a predefined threshold value, the end cap 27 reaches a release position (R). The state and the relative positions of the individual components of the releasable locking mechanism 20, when the end cap 27 is in the release position (R) is as depicted in FIGS. 8A and 8B.

Figure 8A:
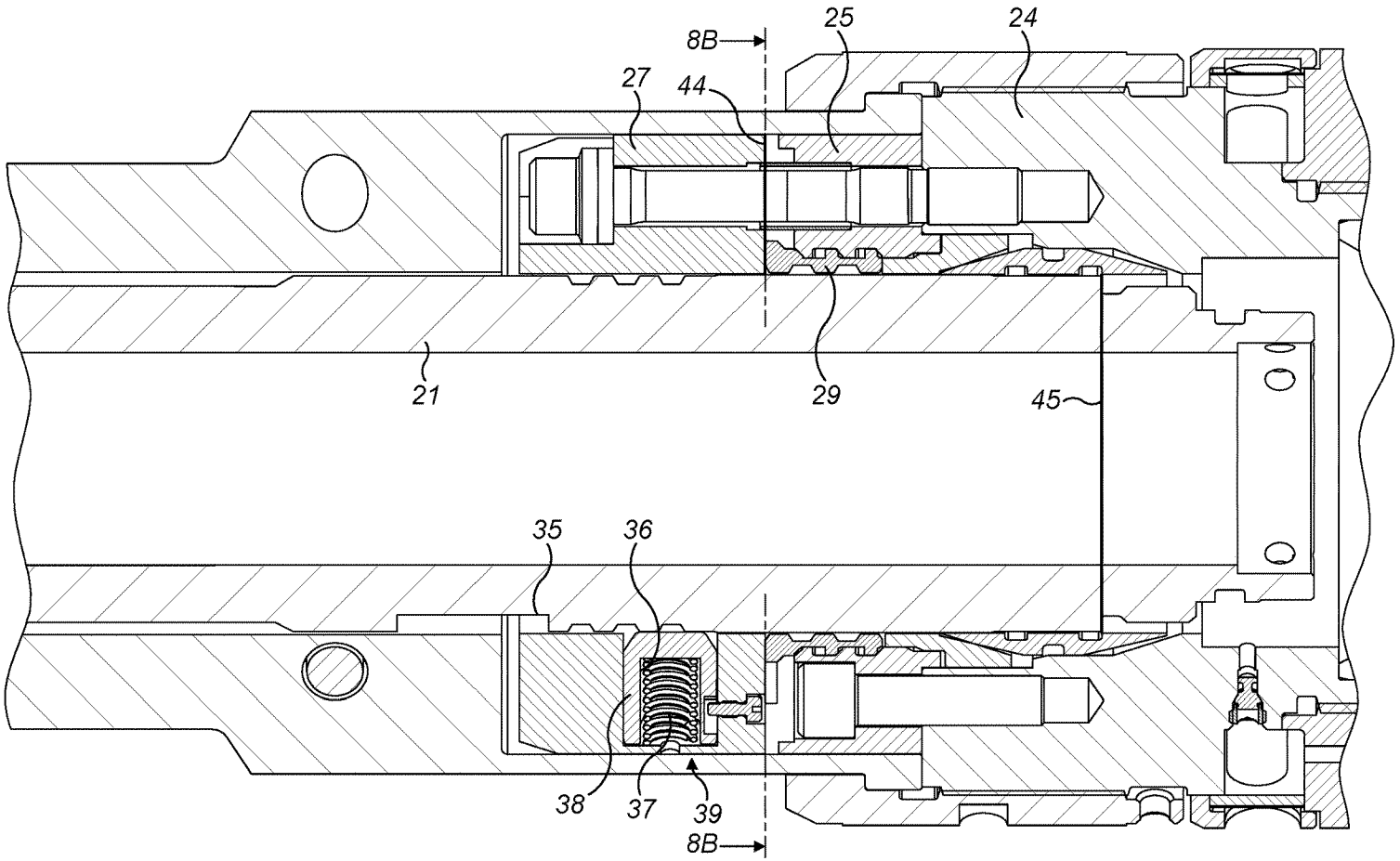
FIGS. 8A-8B depict cross-sectional views of a releasable locking mechanism in a disengaged state in accordance with some embodiments.
Figure 8B:
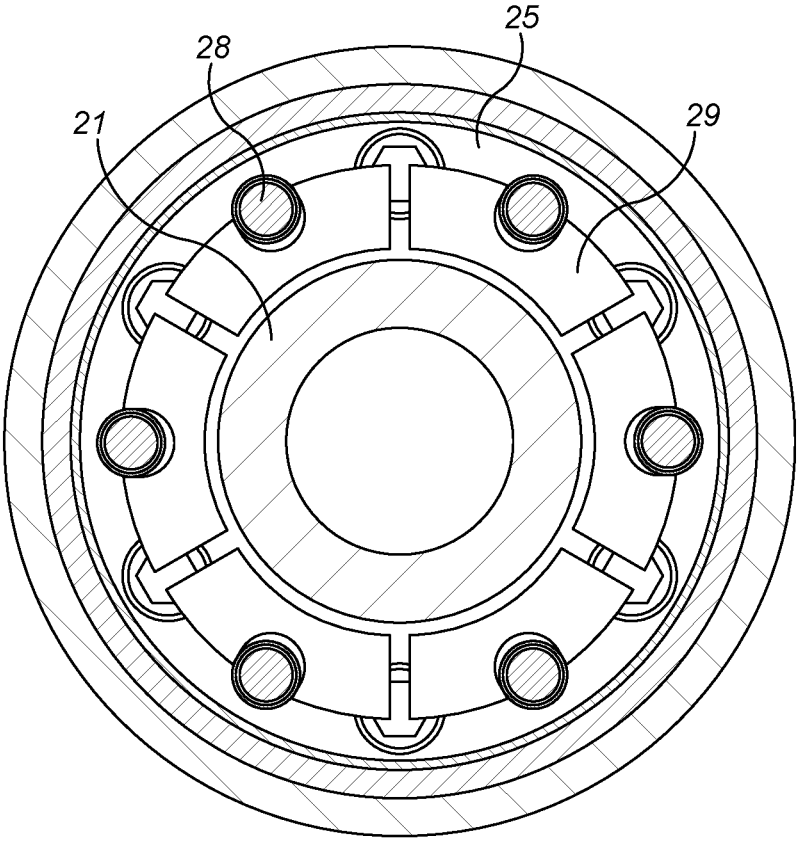

Referring now to FIGS. 8A and 8B, an axial cross-sectional view and a transverse cross-sectional view respectively of a releasable locking mechanism 20 in a disengaged state are depicted.

When the end cap 27 is displaced to the release position (R), the release collet 29 is permitted to displace in the axial direction (Z) away from the base 24 and expand in the radial direction at least partially into the recess 26 of the release ring 25 such that the first mating profile 22 and the second mating profile 30 are disengaged, thereby releasing the extension tube 21. The relative positions of the end cap 27 and the extension tube 21 are indicated using indication 44 and indication 45.

In an embodiment, the release ring 25 may be provided with a recess on the inner surface such that the axial length of the recess 26 matches the axial length of the release collet 29. In this example, the release collet 29 slides one full length and expands into the recess formed in the release ring 25.

In another embodiment, as described above, the release ring 25 might be provided with a first toothed profile 31, such that multiple recesses 26 are formed therein and the release collet 29 is provided with a second profile such that when the end cap 27 is in the locking position (L), the first toothed profile 31 and the second toothed profile 32 engage in a non-mating manner and when the end cap 27 transitions to the release position (R), the first toothed profile 31 and the second toothed profile 32 engage in a mating manner, thereby permitting the release collet 29 to expand radially outwards, as best seen in FIG. 8B. In this embodiment, the first mating profile 22, the second mating profile 30, the first toothed profile 31 and the second toothed profile 32 might be dimensioned in such manner that when the first toothed profile 31 and the second toothed profile 32 engage in a non-mating manner, the first mating profile 22 and the second mating profile 30 engage in a mating manner and vice versa.

As can be seen in FIG. 7A, the anti-rotation latches 36 protrude outwards from the corresponding housing slot 39 to engage the extension tube 21 during the engaged state of the releasable locking mechanism 20. As the extension tube 21 begins to displace in the axial direction (Z) away from the base 24, the anti-rotation latches 36 begin to retract inside the housing slot 39, until the anti-rotation slots 35 are fully disengaged, as can be seen in FIG. 8A.

Figure 9:
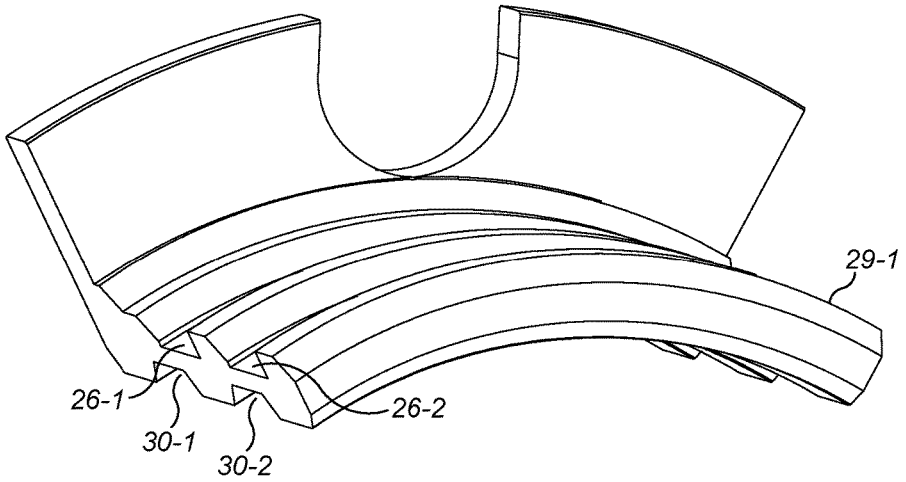
FIG. 9 depicts a perspective view of a sub-part of a multi-piece release collet in accordance with some embodiments.
Figure 10A:
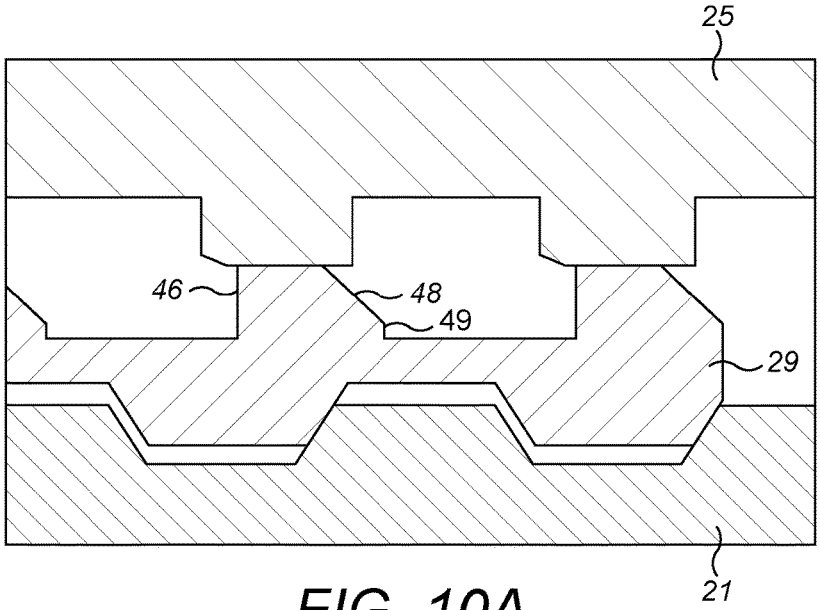
FIGS. 10A-10D depict cross-sectional views showing changes in relative engagement of a first and a second toothed profiles disposed respectively on a release collet and a release ring in accordance with some embodiments.
Figure 10B:
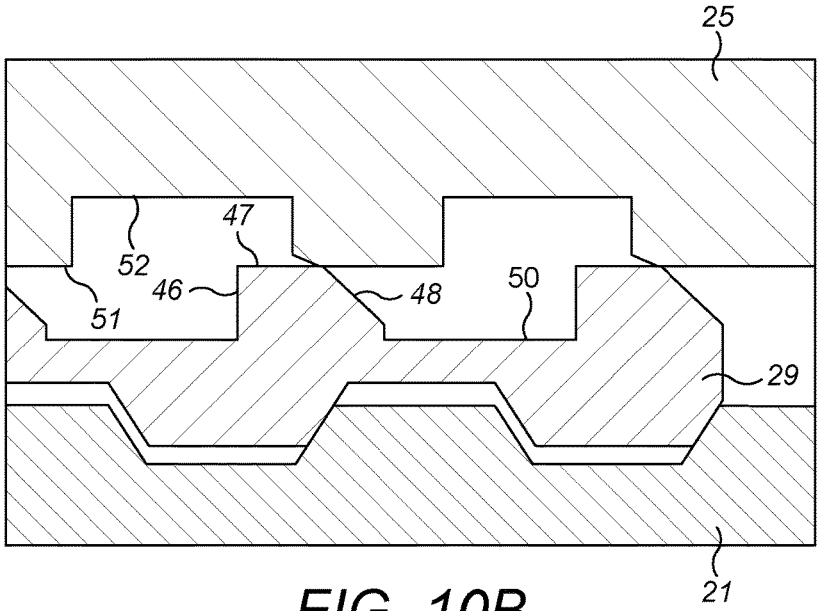
Figure 10C:
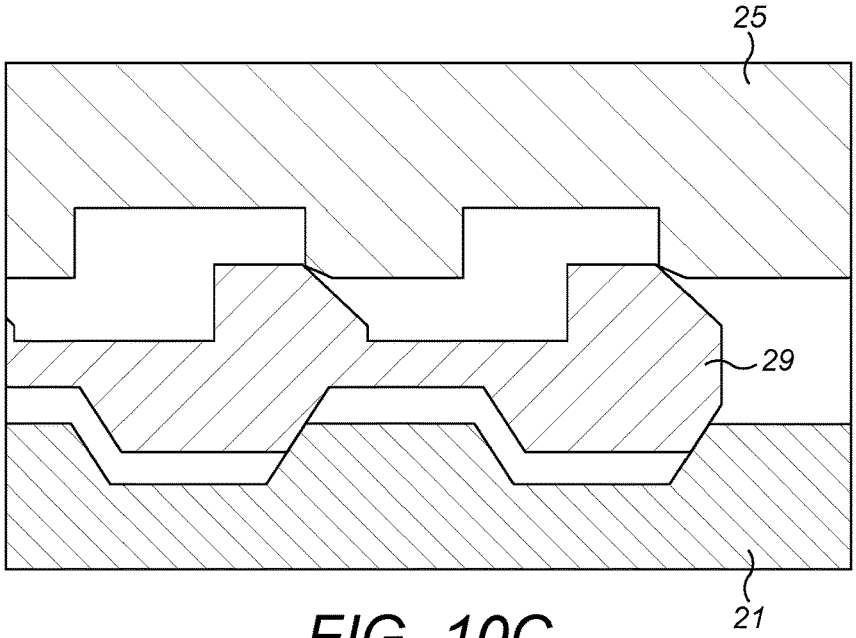
Figure 10D:
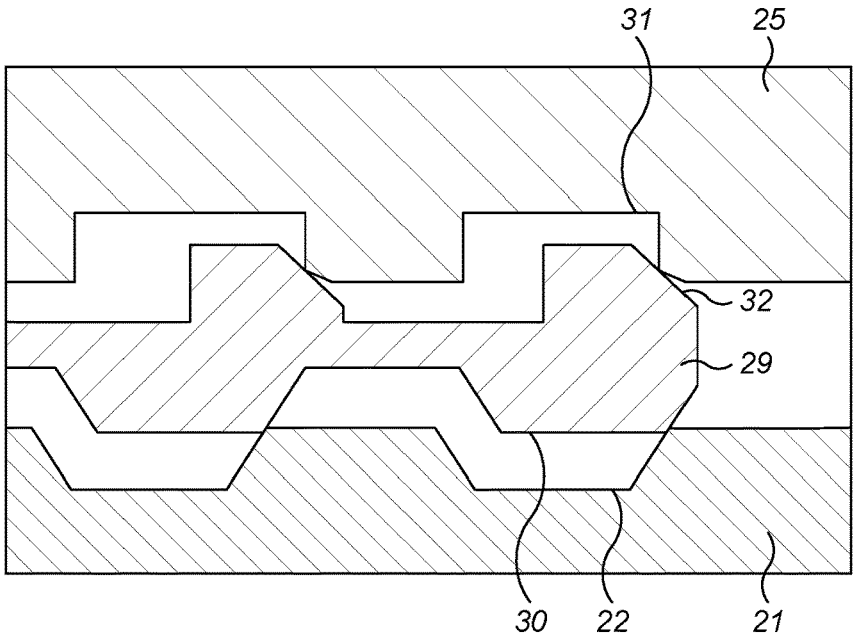
Figure 11:
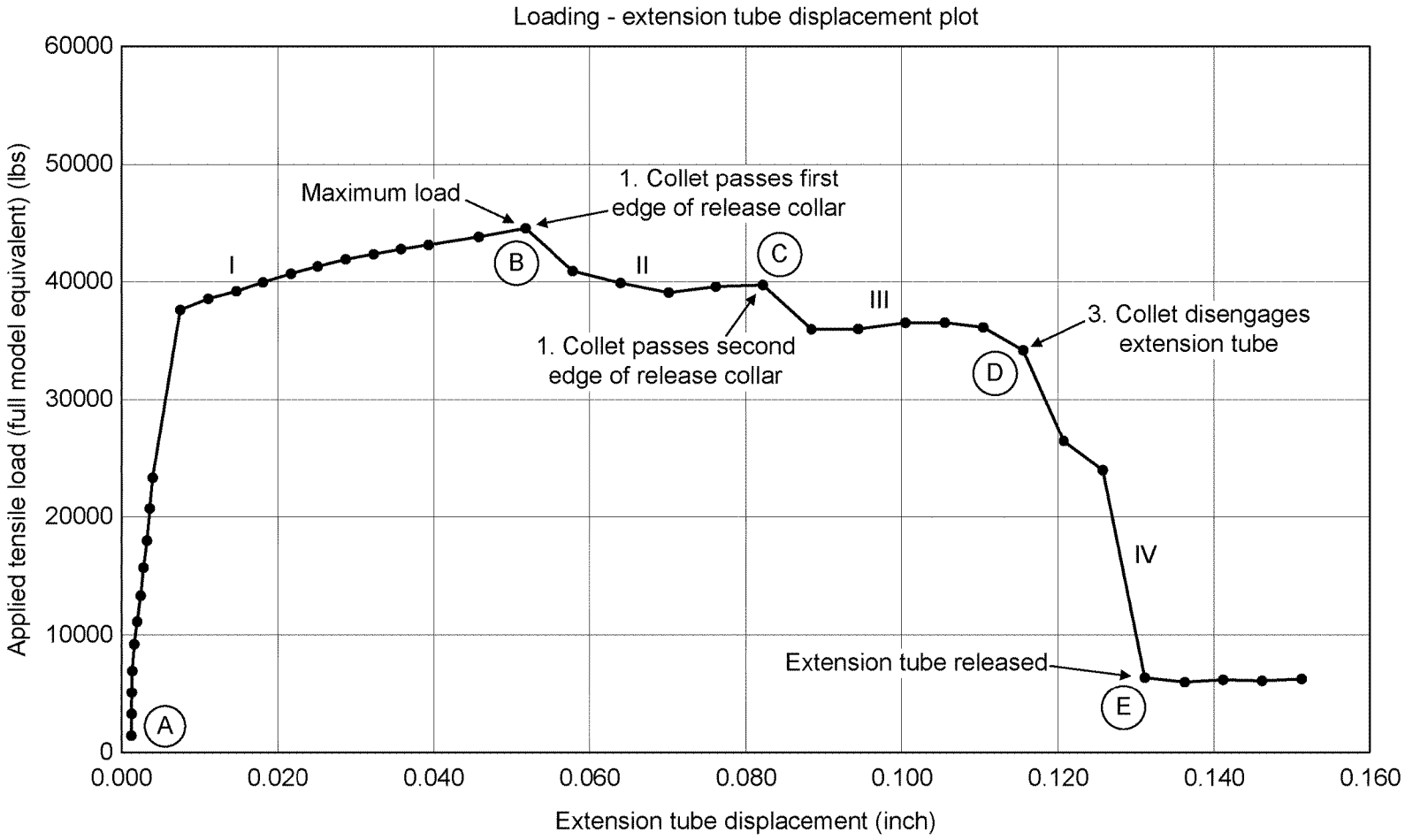
FIG. 11 depicts a graphical representation of variation of tensile load in a cable line as a function of displacement of an extension tube relative to a base assembly in accordance with some embodiments.

Referring now to FIGS. 9 to 11, changes in relative engagement of the first toothed profile 31 and the second toothed profile 32 as the end cap 27 is displaced from the locking position (L) to the release position (R) are shown along with the resulting variation in the tensile load in the releasable locking mechanism 20.

In particular, FIG. 9 depicts a perspective view of a sub-part 29-1 of a multi-piece release collet 29 in accordance with an embodiment. The cross-sectional profile of the second toothed profile 32 is asymmetric in that the cross-sectional profile includes a flat face 46 facing in a direction away from the base 24, a flat top 47, a sloping face 48, and a flat face 49, as best seen in FIG. 10.

FIGS. 10A to 10D depict cross-sectional views showing changes in relative engagement of the first toothed profile 31 and the second toothed profile 32 disposed respectively on the release collet 29 and the release ring 25. The second toothed profile 32 includes a series of flat faces 51 and 52.

As shown in FIG. 10A, when the end cap 27 is in the locking position (L), the first toothed profile 31 and the second toothed profile 32 engage in a non-mating manner wherein the flat face 47 interfaces with the flat face 51 (stage I, between points A and B). As the release collet 29 begins to displace away from the base 24, at first, the flat face 47 crosses the boundary between the flat faces 51, 52 (stage II, between points B and C). As the release collet 29 displaces further away from the base 24, the flat face 47 moves out of contact with the flat face 51, which is then engaged by the sloping face 48 (stage III, between points C and D). As the release collet 29 continues to displace further away from the base 24, the release collet 29 begins expanding radially outwards into the recess 26 formed between the flat faces 51. Eventually, the release collet 29 expands such that the flat face 50 comes in contact with the flat face 51, at which point, the first mating profile 22 and the second mating profile 30 are disengaged (stage IV, between points D and E).

FIG. 11 depicts a graphical representation of variation of tensile load in a cable line as a function of displacement of the extension tube 21 relative to a base assembly 23 when the first toothed profile 31 and the second toothed profile 32 are implemented in the manner shown in FIGS. 10A through 10D. The tensile load varies over different stages of relative engagement between the first toothed profile 31 and the second toothed profile 32, as explained above. The relative engagement between the first toothed profile 31 and the second toothed profile 32 is in turn, is a function of the displacement of the extension tube 21.

During a release operation, the tensile load continues to increase and reaches the maximum value until the flat face 47 is in contact with the flat face 51. Once the displacement enters the region indicated as stage II (that is, between points B and C on the graphical representation), the residual energy in the cable line 13 causes the mechanism to gain momentum quickly and hence, sustained application of tensile load is not necessary throughout the entire duration of the displacement of the release collet 29 relative to the release ring 25.

Figure 12:
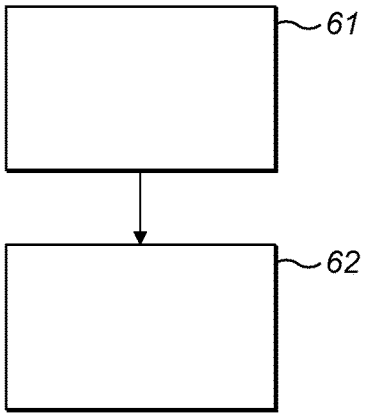
FIG. 12 depicts a method for using a releasable locking mechanism in accordance with some embodiments.

Referring now to FIG. 12, an example of a method for using a releasable locking mechanism of the disclosure is depicted. The method is suitable for releasably locking a cable line to a downhole apparatus. The method includes coupling (61) a cable line to a downhole apparatus using a releasable locking mechanism of the disclosure and applying (62), a tensile load to the cable line equal to or greater than the predefined threshold value such that the cable line is disengaged from the downhole apparatus. Step 62 may be performed when it is desired to retrieve the downhole apparatus, which is stuck in the downhole well.

As will now be understood based on the above description, the present disclosure comprises mechanical actuation and obviates the need for provision of cumbersome and error-prone hydraulic or electrical actuation systems. While the releasable locking mechanism of the present disclosure is based on a mechanical design, the mechanism advantageously does not rely on shearing or breaking coupling elements such as shear pins in order to release the cable line from the downhole apparatus. Accordingly, the problems associated with broken pieces of coupling means such as shear pins are advantageously avoided. Further, the extendible retaining means can be configured with precision to achieve a release at a predefined threshold value of the tensile load applied to the cable line. Thus, the releasable locking mechanism according to the present disclosure is not only reliable but also much more precise.

The invention claimed is:

1. A releasable locking mechanism for use with a cable termination assembly, the cable termination assembly being coupled to a downhole apparatus and configured for coupling a cable line thereto, the releasable locking mechanism comprising:

an extension tube adapted to be coupled to the cable line and comprising a first mating profile, and a base assembly adapted to be coupled to the cable termination assembly and further adapted to engage the extension tube, the base assembly comprising:

a base adapted to be coupled to the cable termination assembly, a release ring mounted on the base and defining a recess, an end cap, an extendible retainer adapted to bias the end cap toward the base and adapted to permit an axial displacement of the end cap from a locking position to a release position relative to the base when a tensile load in the cable line exceeds a predefined threshold value, and a release collet comprising a second mating profile adapted for mating with the first mating profile, wherein when the end cap is held in the locking position, the release collet is restrained from displacement in an axial direction away from the base by the end cap and in a radial direction by the release ring such that the first and second mating profiles are engaged, thereby retaining the extension tube, and wherein when the end cap is displaced to the release position, the release collet is permitted to displace in the axial direction away from the base and expand in the radial direction at least partially into the recess of the release ring such that the first and second mating profiles are disengaged, thereby releasing the extension tube.

2. The releasable locking mechanism according to claim 1, wherein the first mating profile comprises a first set of circumferential recessed profiles spaced apart in the axial direction and provided on an outer surface of the extension tube, and the second mating profile comprises a second set of circumferential recessed profiles spaced apart in the axial direction and provided on an inner surface of the release collet.

3. The releasable locking mechanism according to claim 1, wherein the recess of the release ring is part of a first toothed profile in the axial direction on an inner surface of the release ring, and the release collet is provided with a second toothed profile adapted for mating with the first toothed profile, and wherein the release ring and the release collet are arranged such that when the end cap is held in the locking position, the first and second toothed profiles engage in a non-mating manner and the release collet is biased toward the extension tube by the release ring, and when the end cap is displaced to the release position and the release collet displaces in the axial direction away from the base, the first and second toothed profiles engage in a mating manner, and thereby, permit radial expansion of the release collet.

4. The releasable locking mechanism according to claim 1, wherein the base assembly comprises a sealing member disposed at an interface between the extension tube and the base.

5. The releasable locking mechanism according to claim 4, wherein the base assembly comprises a seal compression ring disposed between the sealing member and the release collet such that when the end cap is in the locked position, the seal compression ring compresses the sealing member such that the sealing member is urged toward respective inner surfaces of the base and the extension tube.

6. The releasable locking mechanism according to claim 1, wherein the extension tube comprises a set of anti-rotation slots, and the end cap comprises a set of anti-rotation latches, wherein each anti-rotation latch comprises a sprung key and a casing, and protrudes radially inwards from a corresponding housing slot formed in an inner surface of the end cap, wherein the casing is profiled to prevent a rotational motion of the extension tube about the axial direction but permit a translational motion of the extension tube in the axial direction.

7. The releasable locking mechanism according to claim 1, wherein the extendible retainer comprises at least one tension bolt, each tension bolt comprising at least a head region, a tail region, and a neck region, wherein the at least one tension bolt extends in the axial direction, wherein the head region is engaged by the end cap, the tail region is engaged by the base, and the neck region extends through the release ring.

8. The releasable locking mechanism according to claim 1, wherein the extendible retainer comprises a set of tension bolts, each tension bolt comprising at least a head region, a tail region, and a neck region, wherein the tension bolts are uniformly distributed along a periphery of the end cap, and extend along the axial direction, wherein the head region is engaged by the end cap, the tail region is engaged by the base, and the neck region extends through the release ring.

9. The releasable locking mechanism according to claim 1, wherein the release collet comprises a plurality of longitudinally extending sub-parts coupled in a pair-wise manner in a circumferential direction.

10. The releasable locking mechanism according to claim 1, wherein when the extension tube and the base assembly are engaged, a load path traverses through the extension tube, the first mating profile on the extension tube, the second mating profile on the release collet, the release collet, the end cap, the extendible retainer and the base.

11. The releasable locking mechanism according to claim 1, wherein the base assembly comprises a fishing profile secured to the base through a retaining ring.

12. A method comprising:

coupling a cable line to a downhole apparatus through a releasable locking mechanism, wherein the releasable locking mechanism comprises:

an extension tube coupled to the cable line and comprising a first mating profile, and a base assembly coupled to the cable termination assembly and engaging the extension tube, the base assembly comprising:

a base coupled to the cable termination assembly, a release ring mounted on the base and defining a recess, an end cap, an extendible retainer that biases the end cap toward the base and is configured to permit an axial displacement of the end cap from a locking position to a release position relative to the base when a tensile load in the cable line exceeds a predefined threshold value, and a release collet comprising a second mating profile adapted for mating with the first mating profile, wherein when the end cap is held in the locking position, the release collet is restrained from displacement in an axial direction away from the base by the end cap and in a radial direction by the release ring such that the first and second mating profiles are engaged, thereby retaining the extension tube, and wherein when the end cap is displaced to the release position, the release collet is permitted to displace in the axial direction away from the base and expand in the radial direction at least partially into the recess of the release ring such that the first and second mating profiles are disengaged, thereby releasing the extension tube, and applying a tensile load to the cable line equal to or greater than the predefined threshold value such that the cable line is disengaged from the downhole apparatus.

* * * * *